US005098330A

United States Patent [19]

Greenberg

[11] Patent Number: 5,098,330

[45] Date of Patent: Mar. 24, 1992

[54] BREAST ENHANCEMENT BRASSIERE

[76] Inventor: Bert Greenberg, 2030 S. Ocean Dr., Hallandale, Fla. 33009

[21] Appl. No.: 675,685

[22] Filed: Mar. 27, 1991

[51] Int. Cl.[5] ..... A41C 3/10

[52] U.S. Cl. ..... 450/55; 450/31; 450/32; 450/39; 450/40; 450/41; 450/51; 450/52; 450/57

[58] Field of Search ..... 450/30, 31, 32, 39, 450/40, 41, 56, 54, 53, 52, 51, 56, 57, 58, 60

[56] References Cited

U.S. PATENT DOCUMENTS

| | | | |
|---|---|---|---|
| 2,697,229 | 12/1954 | Krueger | 450/38 |
| 3,181,536 | 5/1965 | Cannata | 450/57 |
| 3,568,681 | 3/1971 | Comollo | 450/57 X |
| 3,834,397 | 9/1974 | Birch | 450/56 |
| 4,199,825 | 4/1980 | Knoche | 450/55 X |
| 4,380,569 | 4/1983 | Shaw | 450/55 X |

FOREIGN PATENT DOCUMENTS

| | | | |
|---|---|---|---|
| 0627409 | 9/1961 | Canada | 450/36 |
| 0693525 | 7/1940 | Fed. Rep. of Germany | 450/37 |

*Primary Examiner*—Werner H. Schroeder
*Assistant Examiner*—Jeanette E. Chapman
*Attorney, Agent, or Firm*—McAulay Fisher Nissen Goldberg & Kiel

[57] ABSTRACT

A breast enhancement brassiere is disclosed wherein each of the breast cups is constructed having an inner pocket which receives a padding material and an outer pocket which receives a removable elastomeric member. A support wire extends along the lower curved edge of each cup. The upper edge of each cup defines a relatively unconstrained open zone. The configuration is such that the brassiere, when worn, exerts forces on the wearer's breats lifting the breasts both upwardly and inwardly toward each other in the direction of the open zone for breast enhancement.

7 Claims, 2 Drawing Sheets

BREAST ENHANCEMENT BRASSIERE

BACKGROUND OF THE INVENTION

I. Field of the Invention

This invention relates generally to a brassiere and, more specifically, to a brassiere which exerts forces on the wearer's breast lifting the breasts upwardly and inwardly toward each other for breast enhancement.

II. Description of the Prior Art

Heretofore, it is known to construct a brassiere having padded breast cups for breast enhancement. Brassieres of such construction are worn by women having small breasts who wish to enhance their appearance without resorting to surgical techniques; such as, breast implants. The padding in such brassieres may be a polyester used to make a fiber fill. Padding of this kind typically has little or no resiliency. As such, the padded cups do not provide the feel of real breasts.

It also is known to construct a padded brassiere having a pocket in each cup to receive a foam insert. These inserts are sponge-like in construction so as to be compressible. As such, they are not sufficiently resilient to simulate the feel of real breasts. Also, where the insert is made of latex foam, it has the tendency to disintegrate in a relatively short period of time. In those instances where the insert is made of polyurethane form, the material tends to oxidize over time and change color. This presents problems in terms of appearance, particularly if the outer garment is transparent to reveal the color of the brassiere.

The present invention improves on the heretofore known breast enhancement brassieres by providing a long lasting structure which substantially duplicates the feel of real breasts, provides added dimension in terms of volume of the breast cups, enhances the cleavage between the breasts, and provides breast cups having a flesh-tone appearance.

SUMMARY OF THE INVENTION

The brassiere of the present invention is constructed having a pair of spaced-apart breast cups. Each of the cups has an inner fabric lining, an outer fabric lining and an intermediate fabric lining. Each of the linings are joined to form a curved lower edge of the cup and an upper edge.

The space between the inner lining and the intermediate lining adjacent the lower edge of the cup defines a channel which receives a support wire positioned therein. The space between the inner lining and the intermediate lining above the channel defines a first pocket which receives a padding material therein. The space between the outer lining and the intermediate lining defines a second pocket which receives a shallow bowl-shaped elastomeric member removably positioned therein. The outer surface of the padding material is substantially congruent with the inner surface of the elastomeric member.

The upper edge of each cup has a relatively unconstrained open zone. The configuration is such that the brassiere, when worn, exerts forces on the wearer's breasts lifting the breasts both upwardly and inwardly toward each other in the direction of the open zone for breast enhancement.

DESCRIPTION OF THE PREFERRED EMBODIMENT

Figure 1:
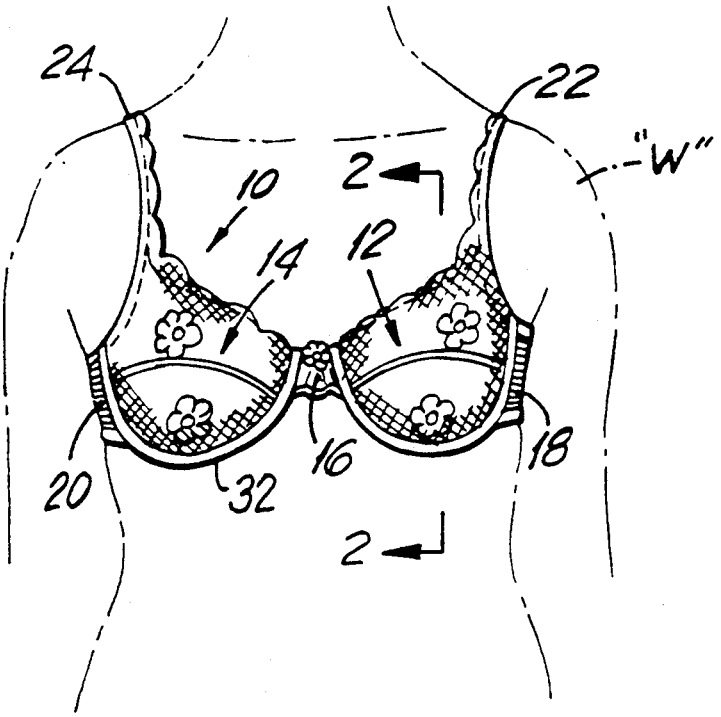
FIG. 1 is a front elevational view of a brassiere constructed in accordance with the present invention being worn by a wearer and without the elastomeric member positioned in the breast cups.

Referring to the drawings, particularly FIGS. 1–4, numeral 10 represents a breast enhancement brassiere constructed in accordance with the present invention. Brassiere 10 includes a pair of spaced-apart breast cups 12 and 14 joined by a center section 16 which may be regarded as defining a vertical centerline of the garment. A pair of combined side and back panels 18 and 20 are joined, respectively, to the breast cups 12 and 14. The breast cups 12 and 14 and the side/back panels 18 and 20 merge upwardly to form shoulder straps 22 and 24. The side/back panels 18 and 20 and the shoulder straps 22 and 24 are preferably made of elastic material as in well known in the art. Also, interengaging fastening elements (not shown) are provided on the back panels 18 and 20 in the region adjacent the wearer's "W" back for assembling brassiere 10 to the body of the wearer. Alternatively, center section 16 may be formed of two separable segments having the interengaging fastener elements for assembling brassiere 10 to the wearer's body.

Figure 2:
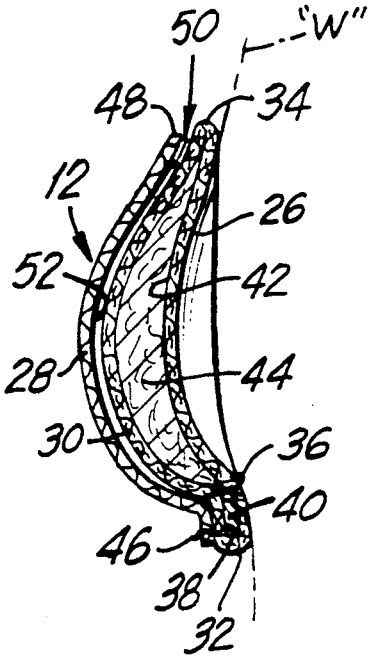
FIG. 2 is a sectional view taken along line 2—2 of FIG. 1.
Figure 4:
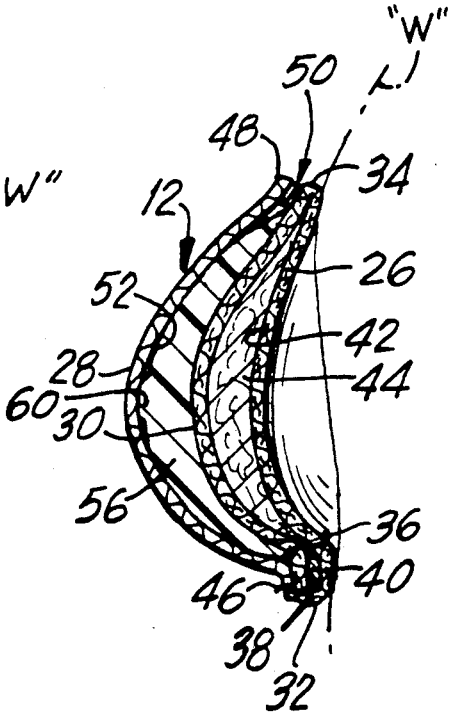
FIG. 4 is a sectional view taken along line 4—4 of FIG. 3.

The construction of each of the breast cups 12 and 14 is shown in FIGS. 2 and 4. Specifically, each cup has an inner fabric lining 26, an outer fabric lining 28 and an intermediate fabric lining 30 disposed between the inner and outer linings. The outer lining 28 may be made of substantially transparent lace fabric for reasons hereinafter described.

Figure 3:
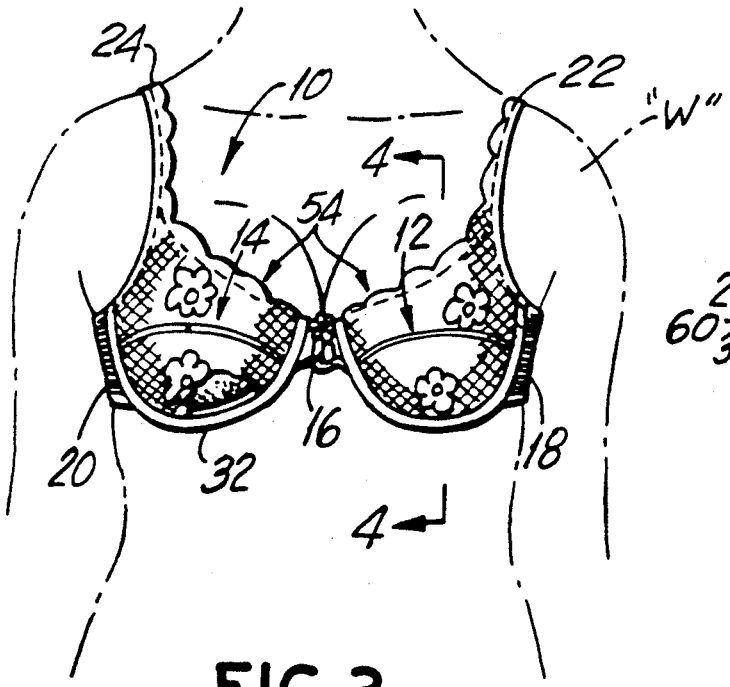
FIG. 3 is a view similar to FIG. 1 with the elastomeric member positioned in each of the breast cups for breast enhancement.

The inner and intermediate linings 26 and 30 may either be two separate members sewn together at their upper and lower edges or a single member folded upon itself and then sewn together along the free edges. Regardless of the manner of securing linings 26 and 30 together, they are secured to form a curved lower edge 32 of the associated cup and an upper edge 34 as shown in FIGS. 1 and 3.

The lower region of inner and intermediate linings 26 and 30 are secured together, such as by stitching 36, to form a channel 38 located between stitching 36 and lower edge 32. A support wire 40 is positioned within channel 38 prior to stitching of the linings together. Alternatively, if channel 38 is formed having an open end, the wire 40 may be slid into the channel after the linings are secured together. Wire 40 follows the curvature of lower edge 32 and extends from center section 16 to the region where the associated shoulder strap merges with the side/back panel. Where the brassiere is worn, the wire 40 exerts forces tending to support and lift or push the breasts upwardly.

The space between inner lining 26 and intermediate lining 30 defines a first pocket 42 which receives a padding material 44 therein. The padding may be a polyester fiber fill. Also, if desired, padding 44 may be shaped to provide a ledge or shelf on which the lower portion of the breast rests. Padding 44 provides a limited degree of breast enhancement when the brassiere is worn. However, there is very little enhancement in terms of creating cleavage as shown in FIG. 1. As will be appreciated, padding 44 is inserted into pocket 42 prior to securing the linings together.

The outer lining 28 is secured to the intermediate lining 30 along the lower edge 32 by stitching 46. The upper edge 48 of outer lining 28 is spaced from the upper edge 34 of the cup and is separably secured thereto by a plurality of interengaging fastener elements, represented by numeral 50, extending along said upper edges 34 and 48. The space between outer lining 28 and intermediate lining 30 defines a second pocket 52 which is selectively rendered opened or closed depending on the state of engagement of fasteners 50.

The upper edges 34 and 48 of said linings collectively represent the upper edge of the brassiere cup which defines a relatively unconstrained open zone represented generally by numeral 54 in FIGS. 1 and 3. Open zone 54 begins in the region where the shoulder strap merges with the upper edge of the associated breast cup and extends to the region where the end of support wire 40 merges with center section 16.

Figure 5:
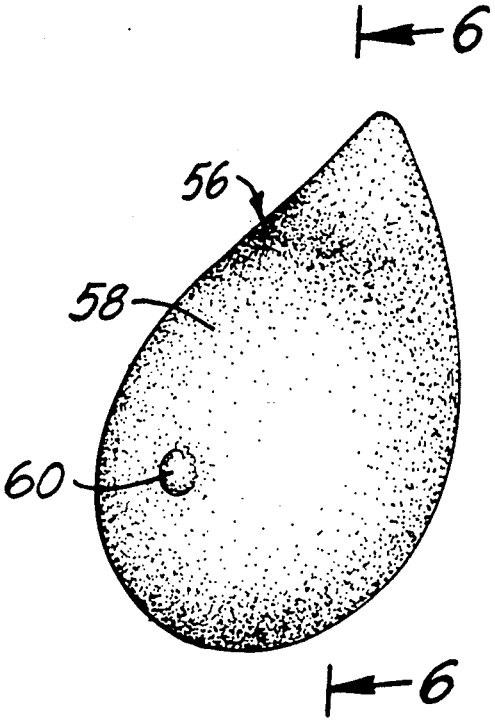
FIG. 5 is a perspective view of the elastomeric member.
Figure 6:
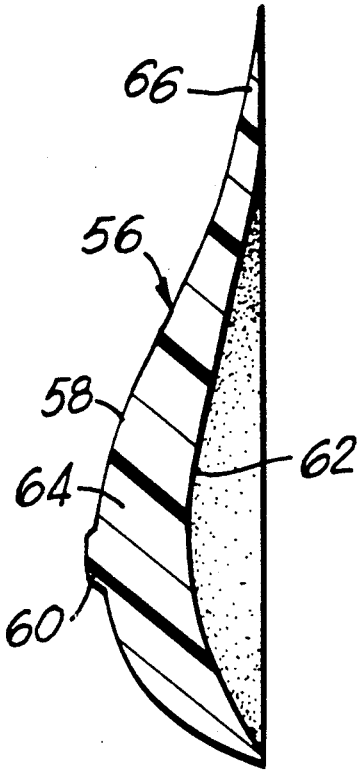
FIG. 6 is a sectional view taken along line 6—6 of FIG. 5.
Figure 7:
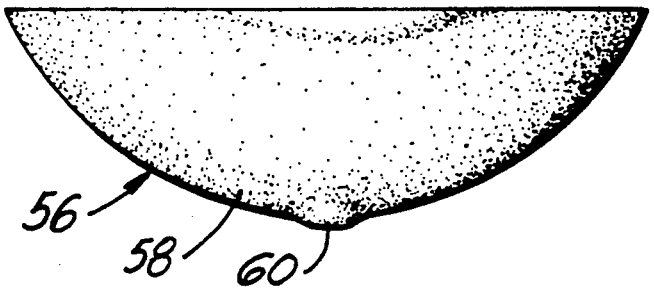
FIG. 7 is a top plan view of the elastomeric member shown in FIG. 5.

The invention further provides for an elastomeric member 56 to be removably positioned in second pocket 5 when the brassiere is in use. The elastomeric member is resiliently deformable, such that, while it can be deformed upon application of pressure, on release of the pressure, it resumes its original shape. A variety of known materials can be used for the elastomeric member, e.g., silicone rubber, encapsulated silicone oils, natural or synthetic rubber, and other elastomeric synthetic polymers, and the like. Referring to FIGS. 5-7, elastomeric member 56 is constructed as a shallow bowl-shaped member preferably having a flesh-tone color. The outer surface 58 of member 56 is formed having a protrusion 60 which is positioned to be representative of a breast nipple. The inner surface 62 is shaped to accommodate the curvature of the padding material 44 in pocket 42. That is, when elastomeric member 56 is inserted in pocket 52, the outer surface of padding 44 is substantially congruent with the inner surface 62 of elastomeric member 56. Disengagement of fastener elements 50 permit elastomeric member 56 to be removed from pocket 52 for purpose of cleaning the brassiere. In construction, elastomeric member 56 is formed having a central zone 64 and a peripheral zone 66. As shown in FIG. 6, central zone 64 is thicker than peripheral zone 66. The material used to form elastomeric member 56 renders said insert resilient.

In use, with the brassiere secured on the wearer's body, and with the elastomeric members in place, compressive forces are exerted on the wearer's breasts which, in combination with padding material 44 and support wire 40, have the tendency to lift or push the breasts both upwardly and inwardly toward each other in the direction of open zones 54. This, in turn, provides breast enhancement as represented by the enhanced cleavage and/or spill-over effect shown in FIG. 3. The brassiere provides small busted women with an added dimension for enhancing the shape and look of their breasts.

The use of padding 44 in combination with elastomeric member 56 results in an elastomeric member of less volume than would otherwise be required if the brassiere had no padding thereby making the brassiere lighter and more comfortable to wear. In the preferred embodiment, the use of silicone as the elastomeric insert member is long lasting as compared to foam inserts.

Another advantage of using the elastomeric member is that it may be formed or constructed having resilience closely resembling the shape and feel of a real breast. Also, where the elastomer member is made of flesh-tone color, the outer lace lining 28 may be constructed to be transparent so that, in appearance, the elastomeric member actually gives the appearance of a real breast.

While a preferred embodiment of the invention has been shown and described in detail, it will be readily understood and appreciated that numerous omissions, changes and additions may be made without departing from the spirit and scope of the invention.

I claim:

1. A brassiere having a pair of spaced-apart breast cups for breast enhancement, each of said cups comprising:

an inner lining, an outer lining spaced from said inner lining, and an intermediate lining disposed between said inner and outer linings;

said inner and intermediate linings being joined to form a curved lower edge of said cup and an upper edge of said cup;

the space between said inner lining and said intermediate lining adjacent to the lower edge of said cup defining a channel;

a support wire positioned within said channel extending along and following the curvature of the lower edge of said cup;

the space between said inner lining and said intermediate lining above said channel defining a first pocket and the space between said outer lining and said intermediate lining defining a second pocket;

a padding material positioned in said first pocket;

said second pocket adapted to receive a shallow bowl-shaped elastomeric member positioned therein;

said inner lining providing a concavely curved surface relative to a wearer's chest with said surface extending from the lower edge to the upper edge of said cup;

an outer surface of said padding material being substantially congruent with an inner surface of said elastomeric member when the member is positioned in said second pocket;

the upper edge of said cup having a relatively unconstrained open zone; and a side/back panel and a shoulder strap connected to each cup for affixing said brassiere to the wearer thereof, one end of said strap extending to the upper edge of said cup;

said open zone extending between said strap end and one end of said support wire;

whereby said brassiere, when worn having the elastomeric member positioned in said second pocket, exerts forces on the wearer's breasts lifting the breasts both upwardly and inwardly toward each other in the direction of said open zone.

2. A brassiere having a pair of spaced-apart breast cups for breast enhancement, each of said cups comprising:

an inner lining, an outer lining spaced from said inner lining, and an intermediate lining disposed between said inner and outer linings;

said inner and intermediate linings being joined to form a curved lower edge of said cup and an upper edge of said cup;

the space between said inner lining and said intermediate lining adjacent to the lower edge of said cup defining a channel;

a support wire positioned within said channel extending along and following the curvature of the lower edge of said cup;

the space between said inner lining and said intermediate lining above said channel defining a first pocket and the space between said outer lining and said intermediate lining defining a second pocket;

a padding material positioned in said first pocket;

a shallow bowl-shaped elastomeric member positioned in said second pocket;

said inner lining providing a concavely curved surface relative to a wearer's chest with said surface extending from the lower edge to the upper edge of said cup;

an outer surface of said padding material being substantially congruent with an inner surface of said elastomeric member;

the upper edge of said cup having a relatively unconstrained open zone; and a side/back panel and a shoulder strap connected to each cup for affixing said brassiere to the wearer thereof, one end of said strap extending to the upper edge of said cup;

said open zone extending between said strap end and one end of said support wire;

whereby said brassiere, when worn, exerts forces on the wearer's breasts lifting the breasts both upwardly and inwardly toward each other in the direction of said open zone.

3. The brassiere of claim 2, wherein said elastomeric member is made of silicone having a central zone and a peripheral zone, said member being thicker at its central zone than at its peripheral zone.

4. The brassiere of claim 2, wherein said elastomeric member is of flesh-tone color, and said outer lining is of substantially transparent lace fabric.

5. The brassiere of claim 2, further comprising interengaging fastening means on said outer lining and said intermediate lining extending along the upper edge of said cup to provide a closure for said second pocket.

6. A brassiere having ak pair of spaced-apart breast cups for breast enhancement, each of said cups comprising:

an inner lining, an outer lining of substantially transparent lace fabric spaced from said inner lining, and an intermediate lining disposed between said inner and outer linings;

said inner and intermediate linings being joined to form a curved lower edge of said cup and an upper edge of said cup;

the space between said inner lining and said intermediate lining adjacent to the lower edge of said cup defining a channel;

a support wire positioned within said channel extending along and following the curvature of the lower edge of said cup;

the space between said inner lining and said intermediate lining above said channel defining a first pocket and the space between said outer lining and said intermediate lining defining a second pocket;

a padding material positioned in said first pocket;

a shallow bowl-shaped resilient silicone member removably positioned in said second pocket, said silicone member being of flesh-tone color;

said inner lining providing a concavely curved surface relative to a wearer's chest with said surface extending from the lower edge to the upper edge of said cup;

an outer surface of said padding material being substantially congruent with an inner surface of said silicone member;

interengaging fastening means on said outer lining and said intermediate lining extending along the upper edge of said cup to provide a closure for said second pocket;

the upper edge of said cup having a relatively unconstrained open zone;

a side/back panel and a shoulder strap connected to each cup for affixing said brassiere to the wearer thereof, one end of said strap extending to the upper edge of said cup; and said open zone extending between said strap end and one end of said support wire;

whereby said brassiere, when worn, exerts forces on the wearer's breasts lifting the breasts both upwardly and inwardly toward each other in the direction of said open zone.

7. The brassiere of claim 6, wherein said silicone member has a central zone and a peripheral zone, said member being thicker at its central zone than at its peripheral zone.

* * * * *